United States Patent [19]

Psaila et al.

[11] 4,339,523

[45] Jul. 13, 1982

[54] PROCESS FOR PRODUCING PHOTOGRAPHIC IMAGES

[75] Inventors: Alexander Psaila, Chelmsford; Katerina Kessler, Brentwood, both of England

[73] Assignee: Ciba-Geigy AG, Basel, Switzerland

[21] Appl. No.: 132,701

[22] Filed: Mar. 21, 1980

[30] Foreign Application Priority Data

Mar. 26, 1979 [GB] United Kingdom ..... 7910538

[51] Int. Cl.[3] ..... G03C 7/00; G03C 5/54

[52] U.S. Cl. ..... 430/239; 430/218; 430/220; 430/222; 430/241; 430/256; 430/390; 430/430; 430/433; 430/524; 430/525; 430/559

[58] Field of Search ..... 430/218, 222, 239, 241, 430/390, 559, 433, 256, 524, 525, 430

[56] References Cited

U.S. PATENT DOCUMENTS

| | | | |
|---|---|---|---|
| 3,725,068 | 4/1973 | Meier | 430/483 |
| 4,233,399 | 11/1980 | Kitzing et al. | 430/558 |
| 4,235,957 | 11/1980 | Kohrt et al. | 430/390 |
| 4,269,928 | 5/1981 | Mason et al. | 430/392 |
| 4,271,254 | 6/1981 | Mason et al. | 430/239 |

*Primary Examiner*—J. Travis Brown

*Attorney, Agent, or Firm*—Sprung, Horn, Kramer & Woods

[57] ABSTRACT

A new method to produce photographic images is provided which comprises:

(a) imagewise exposing a photographic assembly which contains at least during the silver halide developing step, in order optionally a supercoat layer, at least one silver halide emulsion layer, a layer containing a substantive azamethine compound and a photobase, there being optionally one or more interlayers between each of said components (b) treating the exposed photographic assembly with an aqueous processing bath so as to provide in the silver halide emulsion layer or layers a solution or dispersion of a bleach developer compound, thereby to develop the latent silver image in the silver halide emulsion(s), and (c) in the non-latent image areas allowing the bleach developer compound to diffuse in a counter-imagewise manner from the silver halide emulsion layer (s) to the layer containing substantive azamethine compound and there to bleach the compound to form a dye image.

53 Claims, 24 Drawing Figures

PROCESS FOR PRODUCING PHOTOGRAPHIC IMAGES

This invention relates to novel silver halide photographic material and to methods of processing this material to produce photographic images.

Ever since the advent of photography silver halide salts have been used as the photosensitive agent and for the most part developed silver has been used as the image although in colour phtography final dye images have replaced the silver image. However in a large number of photographic materials the final image is still a silver image, e.g. in X-ray materials, microfilms and in graphic arts films as well as in normal black and white high speed camera films. Recently however the price of silver has increased to such an extent that ways have been sought in which silver halide can still be used as the photosensitive agent but in which a final dye image is formed even in the photographic materials listed above. By such means there can be either an almost total recovery of the silver used or at least a great reduction in the amount of silver used.

In one method of colour photography the photosensitive agent is a silver salt and a dye developer is used which develops the silver halide and at the same time releases a dye which diffuses out of the photosensitive layers into a receptor layer which can be peeled apart from the photosensitive layer. Thus a final dye image is obtained whilst leaving all the silver in the residual material and thus recoverable.

In published British patent application No. 2007378A there is described a photographic diffusion process which does not involve the diffusion of dyes but wherein a final dye image is obtained.

In British Pat. No. 2007378A there is described a process for the production of a photogaphic image which comprises the steps of:

(a) imagewise exposing a photographic assembly which comprises at least during the silver halide developing step, in order optionally a supercoat layer, at least one silver halide emulsion layer, a layer containing a bleachable image dye and a photobase, there being optionally one or more interlayers between each of said components, (b) treating the exposed photographic assembly with an aqueous processing bath so as to provide in the silver halide emulsion layer or layers a solution or dispersion of a bleach-developer compound, thereby to develop the latent silver image in the silver halide emulsion(s), and (c) in the non-latent image areas allowing the bleach-developer compound to diffuse in a counter-imagewise manner from the silver halide emulsion layer(s) to the layer containing the bleachable image dye and there to bleach the image dye to form a photographic image.

In British Pat. No. 2007378A bleach-developer compounds are defined as substances which are able to act both as a silver halide developing agent and as a bleaching agent for a bleachable dye.

In British Pat. No. 2007378A the preferred bleachable image dyes are stated to be azo of the type used in silver dye bleach processes such as in the well-known CIBACHROME process (Registered Trade Mark).

We have now found another class of dyes which may be used as the bleachable dyes in the process described in British Pat. No. 2007378A.

Therefore according to the present invention there is provided a process for the production of a photographic image which comprises the steps of:

(a) imagewise exposing a photographic assembly which comprises at least during a silver halide developing step, in order optionally a supercoat layer, at least one silver halide emulsion layer, a layer containing a layer substantive azamethine compound of the general formula

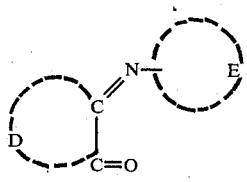

(1)

where D represents the atoms necessary to complete an optionally substituted heterocyclic or aromatic ring, and E is an optionally substituted heterocyclic or aromatic ring, and a support, there being optionally one or more interlayers between each of said components, (b) treating the exposed photographic assembly with an aqueous acid processing bath so as to provide in the silver halide emulsion layer or layers a solution or dispersion of a bleach developer compound thereby to develop the latent silver image in the silver halide emulsion(s) and (c) in the non-latent image areas allowing the bleach-developer compound to diffuse in a counter-imagewise manner from the silver halide emulsion layer or layers to the layer containing the compound of formula (1) and there is bleach the compound to form a dye image.

Preferably D represents the atoms necessary to complete a substituted heterocyclic ring.

Preferred aromatic rings E are a phenylene ring with a parasubstituted amine or substituted amine and a phenylene ring with a para-substituted hydroxy group. There may be other substituents on the phenylene ring, e.g. lower alkyl or alkoxy ($C_1$–$C_4$), both optionally substituted, optionally substituted cycloalkyl or halogen (chlorine, bromine) or cyano.

Preferred heterocyclic rings E are pyrazolones, hydroxypyridone and alloxan.

The term "layer substantive" means that the azamethine dyes are substantive to the layer in which they are coated. As herinafter described, preferably the dyes are present as solid dispersions but they may be present as oil dispersions or mordanted to a mordant, or rendered substantive by reasons of molecular size.

A particularly preferred class of compounds of formaula (1) are those of formula

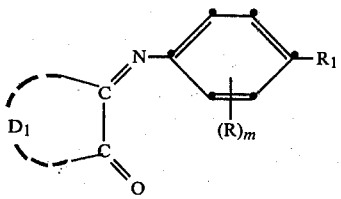

(2)

where $R_1$ represents unsubstituted or substituted amino or hydroxy, R represents substituent groups which may be the same or different, m is 0 to 3 and $D_1$ is a substituted aromatic ring.

The preferred compounds of formula (2) for use in the process of the present invention are the hydroxypyridone dyes described in German published patent application No. 2808825.

Therefore in a preferred form of the process according to the present invention there is provided a process for the production of a photographic image by the process as just described wherein the compound of formula (1) is a hydroxypyridone compound of the general formula

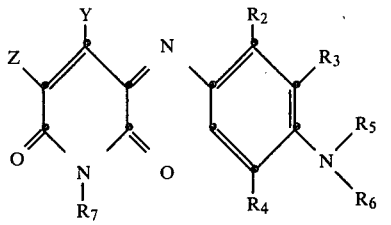

(3)

wherein $R_7$ represents hydrogen or optionally substituted alkyl, aralkyl, cycloalkyl, aryl or a heterocyclic radical or optionally substituted amino, Y represents hydrogen, hydroxy, cyano, —$COOR^1$, —$CONR^1R^2$, —$COR^1$ or optionally substituted alkyl, aralkyl, cycloalkyl, aryl or a heterocyclic radical and Z is H or represents cyano, —$COOR^3$, —$CONR^3R^4$, —$SO_3H$, —$SO_3^-$ or —$COR^3$, where $R^1$, $R^2$, $R^3$ and $R^4$ each independently represent hydrogen or optionally substituted alkyl, aralkyl, cycloalkyl, aryl or a heterocyclic radical, $R_2$, $R_3$ and $R_4$ each independently represent hydrogen, halogen, optionally substituted alkyl, cycloalkyl or alkoxy and $R_5$ and $R_6$ each independently represent hydrogen or optionally substituted alkyl, aralkyl, cycloalkyl, aryl or a heterocyclic radical or $R_5$ and $R_6$ together with the nitrogen atom to which they are attached form a 5- or 6-menbered nitrogen containing heterocyclic ring, or $R_3$ and $R_5$ together with the nitrogen atom and $R_5$ and $R_6$ together with the nitrogen atom form two nitrogen containing heterocyclic rings.

The preferred compounds of formula (3) for use in the process of the present invention are those wherein Z in cyano, —$COOR^3$, —$CONR^3R^4$ or —$COR^3$, the most preferred being those wherein Z is cyano.

Preferably both Y and $R_7$ are alkyl or substituted alkyl and most preferably boty Y and $R_7$ are alkyl having from 1 to 4 carbon atoms.

Another preferred class of compounds of formula (3) for use in the process of the present invention are those wherein $R_7$ is hydrogen and Y is alkyl having from 1 to 4 carbon atoms. Such compounds may exist in the tautomeric form which may be written as formula

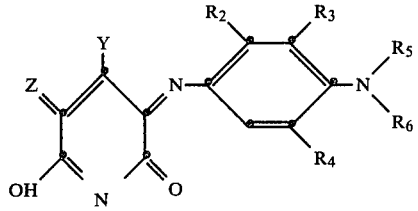

(4)

where the symbols have the meanings assigned to them above.

Preferably in the compounds of formulae (3) and (4) $R_2$, $R_3$ and $R_4$ are each hydrogen. Preferably Y is alkyl having from 1 to 4 carbon atoms. Preferably $R_5$ and $R_6$ are each alkyl or alkoxy wherein the alkyl moiety contains form 1 to 4 carbon atoms.

Particularly suitable compounds for use in the process of the present invention are the compounds of formula

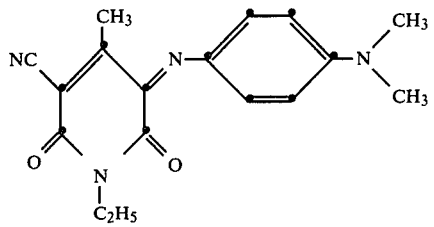

(5)

and the compound of formula

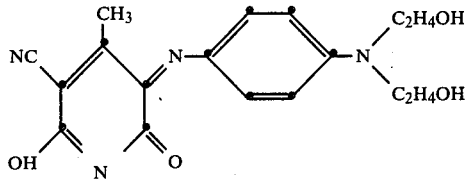

(6)

Another useful class of hydroxypyridone compounds are those of the general formula

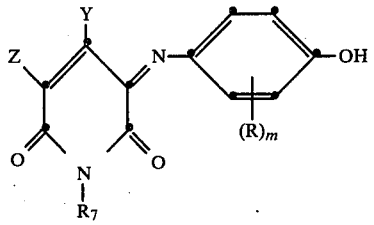

(7)

where Z, Y, R, m and $R_7$ have the meanings assigned to them above.

An example of a compound of formula (7) is the compound of formula

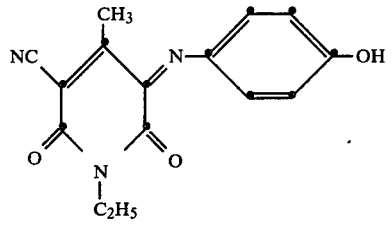

(8)

Another useful class of compounds of formula (1) in the process of the present invention are pyrazolone compounds of the general formula

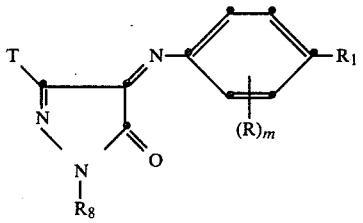

(9)

where R, $R_1$ and m have the meanings assigned to them above and T and $R_8$ are each hydrogen or a substituent.

Preferably in the pyrazolone compounds of formula (9) m is O and $R_1$ is dialkyl substituted amino. Also preferably $R_8$ is aryl and most preferably substituted phenyl. Examples of such substituents include halogen, alkyl and alkoxy. T may be for example alkyl, alkoxy, amino, amido or aryl, any one of which may be optionally further substituted, also an acyl group such as an ester or acid.

Other compounds of formula (1) of use in the process of the present invention are derivatives of barbituric acid or thiobarbituric acid of the general formula

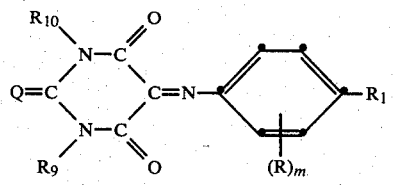

(10)

where R, $R_1$ and m have the meanings assigned to them above and $R_9$ and $R_{10}$ are each hydrogen, alkyl or aryl each of which may be optionally substituted, and Q is oxygen or sulfur.

Also derivatives of ninhydrin of the general formula

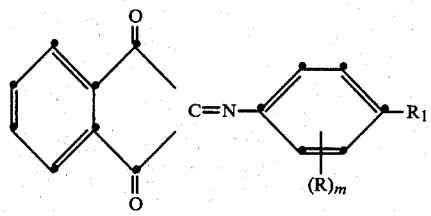

(11)

where R, $R_1$ and m have the meanings assigned to them above.

Also derivatives of oxindole of the general formula

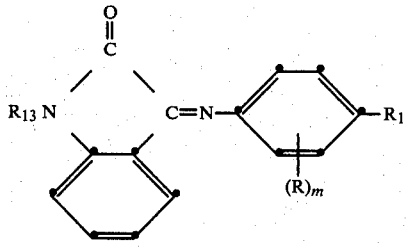

(12)

where R, $R_1$ and m have the meanings assigned to them above and $R_{13}$ is hydrogen, alkyl or aryl.

And derivatives of dimedone or Meldrum's acid of the general formula

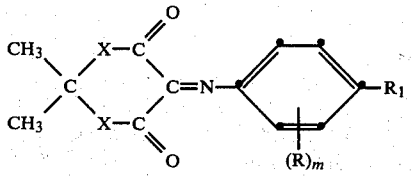

(13)

where R, $R_1$ and m have the meanings assigned to them above and X is $—CH_2—$ or —0—.

Another useful class of compounds of formula (1) are compounds of formula

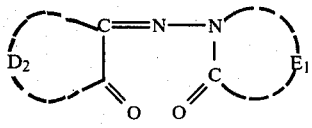

(14)

where both $D_2$ and $E_1$ represent the atoms necessary to complete a heterocyclic ring which is the coupler moiety of a coupled colour coupler. $D_2$ and $E_1$ may be the same or different.

Particularly useful groups $D_2$ and $D_3$ are hydroxypyridone groups of the formula

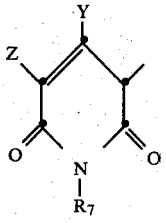

(15)

where Y, Z and $R_7$ have the meanings assigned to them in connection with formula (3), pyrazolone groups of the formula

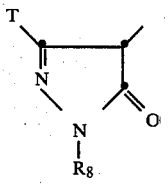

(16)

where T and $R_8$ have the meanings assigned to them in connection with formula (9), and barbituric acid groups of the formula

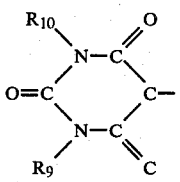

(17)

where $R_9$ and $R_{10}$ have the meanings assigned to them in connection with formula (10).

A particularly useful dye of this class is murexide which has the formula

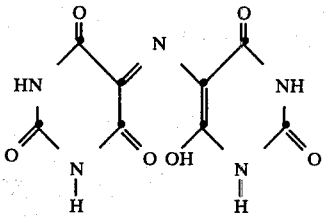

(18)

Another useful class of dyes of formula (14) are bishydroxypyridone dyes of general formula

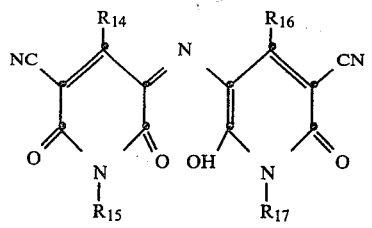

(19)

where each of $R_{14}$, $R_{15}$, $R_{16}$ and $R_{17}$ are selected from methyl or ethyl.

The hydroxypyridone compounds of formula (3) may be prepared as described in German Patent Publication No. 2808825.

The other compounds of formula (1) may be prepared by methods well known in the literature, for example by condensing the parent group of the formula

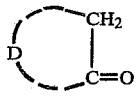

(20)

with a nitroso compound of the general formula

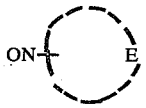

(21)

where in the above two formalae D and E have the meanings assigned to them above.

Advantageously the reaction is carried out in a solvent, preferably acetone, ethanol or acetic acid, with or without internal heating.

The compounds of formula (1) and in particular the hydroxypyridone compounds of formula (3) and the pyrazolone compounds of formula (9) are preferaaly present in the layer of the photographic material as a solid dispersion.

A method of making such a solid dispersion using gelatin as the binder is as follows:

A slurry of the dye (5–20 g) in an alkylphenol alkoxylate (1.0 g of 10% solution) and an alkylphenylpolyethyleneglycolether (1.0 g of 10% solution) in water (78 g) was milled in a colloid mill (e.g. a Dyno Mill at 3000 rpm charged with 0.7 to 1.0 mm grinding media) to a particle size distribution of less than 1 μm in diameter (mean 0.4 to 0.5 um).

A solution of 4% gelatin (decationised blend, pH 6–7) containing 0.15% wetting agent was added gradually to the stirred dispersion. Hardener may be added at this stage if so desired. The concentration of the dispersion was adjusted so as to give a density of 3 at γmax (corresponding to coating weights of 20–30 mg/dm$^{-2}$ of gelatin and 8–10 mg/dm$^{-2}$ of the dye).

By bleach-developer compound is meant a compound which is able to develop a latent silver image and able to bleach the compound of formula (1).

In the process as just set forth the bleach-developer compound may be in the form of a preformed solution or dispersion which is applied to the exposed photographic assembly in step (b).

However bleach-developer compounds tend to be unstable and thus alternative ways of treating the exposed photographic assembly to ensure that sufficient active bleach-developer compound enters the silver halide emulsion layer(s) and especially that sufficient bleach-developer compound diffuses to the layer contianing the compound of formula (1) are preferred.

Thus in one such method the bleach-developer compound is an inactive form and a solution or dispersion of this compound is contacted with a substance which renders the compound active just before or whilst the solution or dispersion is applied to the exposed photographic assembly.

In an alternative to this method the photographic assembly comprises either in the supercoat layer or below the supercoat layer but above the bottom-most silver halide layer a compound in layer form which is able to render active a solution or dispersion of an inactive bleachdeveloper compound. Thus in this method in step (b) a solution or dispersion of an inactive bleach-developer compound is applied to the exposed photographic assembly and when the inactive compound comes into contact with the activating compound it is rendered active and thus able to develop the latent silver image.

In a further alternative method the bleach-developer compound is present initially in a layer in the photographic assembly in an inactive form and in step (b) a solvent for the compound is applied to the exposed photographic assembly and the thus formed solution of the inactive compound is treated in the assembly to convert the compound to the active form. The bleach-developer compound may be treated in the assembly by providing in the assembly as well a substance in layer form which renders active the inactive bleach-developer compound. In another method at the same time or just after the solvent is applied in step (b) the photographic assembly is subjected to electrolysis. This converts the bleach-developer compound to the active form in the assembly.

Similarly electrolysis may be used to convert a solution or dispersion of the inactive bleach-developer compound to the active form, the electrolysis being applied just before or whilst the solution or dispersion is applied to the photographic assembly.

The term photographic assembly of the type defined as used hereinafter means a photographic assembly as defined in (a) of the two processes hereinbefore set forth, that is to say a photographic assembly which comprises at least during the development of the silver halide emulsion an optional supercoat layer, at least one silver halide emulsion layer, a layer containing a compound of formula (1) and a photobase, there being optionally one or more interlayers between each of said components. Thus in the process of the present invention when the exposed photographic assembly of the type defined is treated with an aqueous processing bath so as to provide in the silver halide emulsion layer or layers a solution or dispersion of the bleach-developer compound in the latent image areas of the silver halide emulsion layer(s) the bleach-developer compound develops the latent silver image and be omes oxidised and thus inactive both as a silver halide developing agent and as a bleaching agent for the compound of formula (1). However in the non-latent image areas of the silver halide emulsion layer(s) the bleach-developer compound in solution or dispersion is able to diffuse through the silver halide emulsion, the compound being unaffected by the non-latent image silver halide. When the bleach-developer compound reaches the layer which contains the compound of formula (1), it bleaches the compound to form a photographic image which is of the same type as the silver image formed in the silver halide layer(s). Thus if the image formed in the silver halide emulsion layer(s) is a negative image then a negative dye image is formed in the bleachable dye layer. If the image formed in the silver halide emulsion layer(s) is a positive image then the dye image formed in the bleachable dye layer is a positive image.

It is to be understood that the image part of the photographic assembly as just defined, that is to say the portion of the assembly which includes both the layer which comprises the compound of formula (1) and the photobase, may be joined initially to the photosensitive portion of the assembly, that is to say the portion of the assembly which includes the silver halide emulsion layer(s), or the photosensitive portion of the assembly and the image portion of the assembly may be separate components which are brought together during processing. If the photographic assembly comprises a separate image portion, not connected initially to the photosensitive portion, after the image has been formed in this portion the two components may be separated. However it is sometimes preferred that after processing the two sheets are retained together.

Preferably when the photographic assembly is in two sections the supercoat layer or some other layer is such as to be able to act as a base for the silver halide emulsion layer(s) and the other layers of this section of the assembly.

It is to be understood that the photographic assembly can and ususally does include a number of layers other than the supercoat layer, the silver halide emulsion layer(s), the image substance layer and the optional interlayer or layers between the image dye layer and the photobase. For example there may be opaque layers, there may be light reflecting layers, there may be timing layers which release alkali or acid or other substances as required and/or there may be mordant layers. Example of assemblies of use in the present invention are shown in FIGS. 1 to 24 which follow. However these assemblies are merely representative of the very great number of assemblies which can be used in the process of the present invention.

By bleach-developer compound is meant a compound which is able both to develop a latent silver halide image and to bleach a compound of formula (1). Various classes of bleach-developer compounds are known. Perhaps the best known class is the reduced form of silver dye bleach catalysts. Silver dye bleach catalysts are used in the silver dye bleach process in which they accelerate greatly the silver dye bleach process to bleach the dye in accord with the silver areas. Silver dye bleach catalysts work in an acid solution. The most widely used dye bleach catalysts are diazine compounds, for example pyrazines, quinoxalines and phenazines.

Examples of suitable diazines are pyrazine and its derivatives and quinoxaline compounds, especially those which are substituted in the 2-, 3-, 5-, 6- or 7-position by methyl, methoxy or optionally acylated hydroxymethyl or by optionally acylated amino.

The 1,4-diazine compounds are preferably used in the form of aqueous solutions. The solution can also contain a mixture of two or more diazines.

The diazines can be present in the photographic assembly in suspension or as a solution in a high-boiling solvent. Furthermore, the diazines can be incorporated in capsules in the photographic assembly which can be broken by a change in pressure, temperature or pH, in the light-sensitive layer or in an adjacent layer.

Usable dye bleach catalysts are also described in German Pat. Specifications Nos. 2010707, 2144298 and 2144297, in French Pat. Specification No. 1489460 and in U.S. Pat. No. 2270118.

It is known from BP No. 1183176 that the reduced from of such diazine compounds can act as silver halide developing agents.

Another particularly useful class of bleach-developer compounds are salts of metallic ions and complexes of metallic ions with suitable ligands which are capable of acting as silver halide developing agents.

Metallic ions whichare capable of acting as developing agents for latent silver images are well known (see for example "Photographic Processing Chemistry", by L.F.A. Mason, Focal Press, 2nd Edition, 1975, pages 177–180). Such metallic ions are the lower valency state ions of variable valency metals. In general they act at low pHs to preserve their active lower valency state.

In British Pat. No. 2007378A it was known that metallic ions and complexes of metallic ions with suitable ligands which are capable of acting as developing agents for latent silver images in aqueous acid solution are able also to act in an acid solution as bleaching agents for compounds of formula (1). However they are not silver dye bleach catalysts because after bleaching the bleachable dye they become oxidised to their higher valency state but can not be reduced to their lower valency state by metallic silver as are silver dye bleach catalysts.

Preferred matallic ions for use as silver halide developing agents in the process of the present invention are chromous that is to say $Cr^{++}$, vanadous that is to say $V^{++}$and titanous that is to say $Ti^{+++}$.

There may be present also in the bleach-developer solution which comprises such metall ions a ligand, e.g. ethylene diamine tetraacetic acid, which benefically modifies the redox potential of the metal ions.

The photographic assembly of the type defined may as previously described consist of two components, one the image portion and the other the photosensitive portion. After exposure of the silver halide emulsion layer(s) processing liquid is introduced between them or coated on one of the portions and the two portions are brought together in close contact.

When as assembly of this type is used to perform the invention the processing fluid may contain a bleach-developer compound or an inactive form of the bleach-developer compound which is not able to act either as silver halide developing agent or as dye bleaching agent. In the second case there may be present in the photosensitive portion of the assembly preferably between the supercoat layer and the silver halide emulsion layer(s) a metallic layer as hereinbefore described. When the processing fluid is introduced between the image portion and the photosensitive portion the bleach-developer compound diffuses into this metallic layer and there is reduced to its active state. It then diffuses into the silver halide emulsion layer(s) and there the latent image areas of the silver halide are developed by the compound but in the non-latent image areas the compound diffuses into the image portion there bleaching the dye to form a dye image. Thereafter the image portion containing the dye image may be removed from contact with the photosensitive portion of the assembly. If a preformed bleach-developer compoudn is used in a two-component assembly preferably the supercoat layer comprises one component and the photosensitive portion and image portion are both coated on the photobase and comprise the second component. After exposure of the assembly processing fluid containing the preformed bleach-developer is introduced between the supercoat layer and the emulsion layer. The supercoat layer can be separated from the second component after processing.

However sometimes it is preferably that after processing the two portions of the assembly are not separated but are caused to adhere together. This avoids the production of a disposable photosensitive portion of the assembly.

The formation of the photographic assembly in two halves is of particular use when in-camera processing is to be carried out. In this case in the photographic assembly the photosensitive portion and the image portion may be in contact but not joined. After exposure of the silver halide emulsion layer(s) the processing liquid can be introduced between the two portions, possibly by introducing a pod between the two portions, rupturing the pod and causing the liquid to spread between the two portions which are held in close contact.

However when the photographic assembly is initially in one piece there may be a stripping layer or stripping position. This layer or position is between the silver halide emulsion layer(s) and the image dye layer. When there is such a stripping layer or stripping position sometimes a final step in the process of the present invention is required to activate the stripping effect and to separate the portion of the photographic assembly which comprises the developed silver image from the portion which contains the final dye image on the photobase.

If there is a stripping layer this may be dissolved in a final wash or solution bath. An example of a suitable stripping layer is a phthalated gelatin layer which is swellable in water. However usually the stripping effect takes place during the processing, because for example phthalated gelatin is swellable in an acid processing solution.

Alternatively there may be a stripping position, that is to say the interface between two layers is such that adhesion failure between the two layers can be caused. This adhesion failure may be caused, for example, by change of pH or temperature. The stripping position should be between the silver halide emulsion layer(s) and the image dye layer so that the final step in the process may be to activate the adhesion failure, so separating the photosensitive portion from the image portion. However it is usual for adhesion failure to occur towards the end of processing so that often no actual step to activate stripping is required.

When the photographic assembly is initially in two portions or there is either a stripping layer or stripping position in the photographic assembly as hereinbefore defined, all the silver used as the photosensitive agent can be recovered as the portion of the material containing the silver may be separated from the final image portion.

However there is considerable saving in silver even when the image portion is not separated from the portion containing the silver. In this case the final viewable image is the dye image which is viewed through the transparent photobase, there being also a silver image in the photographic material which is likely to be separated from the dye image by a white opaque layer. In such material the amount of silver halide present in the silver halide emulsion layer can be less than that which would be required if a viewable image were to be formed in the silver halide emulsion layer(s).

The solution of bleach-developer compound of use in the preferred process of the present invention may be prepared and applied to the photographic assembly in a number of different ways.

For example if the bleach-developer compound used is a reduced diazine compound, this compound may be applied to the photographic assembly as a preformed reduced compound. The methods of forming a reduced derivative of 1,4-diazine compound are described in British Pat. Specification No. 1183176.

Alternatively, and this preferrred, the reduced diazine compound is produced during the processing step from a diazine compound of from a N-oxide derived therefrom by use of a reducing agent in layer form in an acid medium, the said reducing agent being a metal which in the electrochemical series of the elements is above silver and up to and including aluminium. This method of processing is described in British Pat. Specification No. 1330755.

For example there may be used a vacuum deposited coated metal strip for example a tin or copper film base strip and there is coated on to this coated strip or on the exposed photographic material a solution or paste which comprises a 1,4 diazine compound in an acid solution. The diazine compound is reduced by the metal and diffuses into the photographic material where the reduced diazine compound in the presence of the acid solution acts as a developing agent for the exposed silver halide.

Alternatively there may be present in the photographic material a layer which contains a fine or colloidal dispersion of a metal which in the electrochemical series is above silver and up to and including aluminium. In fact a colloidal dispersion of aluminium is particularly useful.

In a further alternative method the reduced diazine compounds may be formed in the assembly during the development step by electrolysis.

Similarly if the bleach-developer compound comprises simple or complexed metallic ions in a reduced state these ions may be prepared and applied to the photographic assembly in a number of different ways.

For example (a) a preformed acid solution of the metallic ions may be used, (b) the acid solution of the metallic ions may be formed externally to the photographic assembly but as a step in the processing sequence, (c) the acid solution of the simple or complexed reduced metallic ions may be formed in situ in the photographic assembly during the processing sequence.

Thus in the method (a) above the reduced metal ion may be preformed by known methods, such as electrolytic reduction of as suitable oxidised form or formation of the required metal ion complex by admixture of suitable starting materials in the required oxidation state.

When method (b) is used a strip of a second metal or a strip having a fine colloidal dispersion of a second metal coated thereon is used: the second metal having a reduction potential sufficiently negative to achieve reduction of the oxidised form of the metallic ion to the reduced form of the metallic ion, for example zinc, tin, iron, gallium or indium may be used or alloys containing these metals.

There is coated on to this coated strip which is then applied to the exposed photographic assembly a solution or paste which comprises an oxidised form of the metallic ion in acid solution. The oxidised form of the metallic ion is reduced by the second metal and diffuses into the photographic assembly where the reduced form of the metallic ion in the presence of the acid solution acts as a developing agent for the latent silver halide. In case (c) there may be present in the photographic assembly a layer which contains a fine or colloid dispersion of a second metal which can reduce oxidised forms of the metallic ions to produce the active form of the ions. Such metals are aluminium, zinc, tin, gallium or indium. Also in method (c) the reduced metallic ions may be formed electrolytically in the assembly during the silver halide developing step.

Preferred metals amongst these are those which do not react rapidly with atmospheric oxygen and water at room temperature.

If desired, complex-forming agents for the metals can also be employed during processing.

For example, the fluoride ion forms complexes with aluminium-III ions and the copper-I ion is bonded as a complex by, for example, nitriles, olefines, chloride ions, bromide ions and thioethers. A large number of ligands and also the stability constants of the complexes formed therefrom with various metal ions are listed in the book "Stability Constants of Metal-Ion Complexes", Special Publication No. 17, London: The Chemical Society, Burlington House, W.L., 1964. During processing, a complex-bonded metal ion forms from the complex-forming agent (for example fluoride ions from $NH_4F$ or $CaF_2$ for Al), incorporated in the processing solution or in the material, and the metal, which is present in the form of a layer in the photographic material or is brought into contact with the photographic material during processing, with interposition of the processing bath, and by this means an increase in the reactivity of the metal is achieved.

The use of sparingly soluble compounds as donors of complex-forming agents, for example $CaF_2$ as a fluoride ion donor, has the advantage that an adequate amount of ligand for forming the complex is available without, at the same time, a momentarily undesirable high excess of ligand being present in the solution.

The metals can be distributed in the form of small particles in a layer containing a silver salt or in an adjacent auxiliary layer which may be present. Auxiliary layers can be bonded to the silver salt emulsion layer in an inseparable or readily separable manner. The particles can be dispersed direct in a layer colloid or can additionally be surrounded by a coating of a polymeric substance. Furthermore, the metal particles can be contained in capsules which can be broken open by a change in pressure, temperature or pH. In addition the metals can be supplied for use from small particles of a polymeric substance provided with a metallic coating.

Various embodiments of photographic assemblies of use in the present invention will now be described with references to the accompanying FIGS. 1 to 24.

In FIGS. 1 to 13 the term stripping position has been used: however this may be either an interface between layers at which adhesion failure may occur or it may indicate an actual stripping layer.

Figure 1:
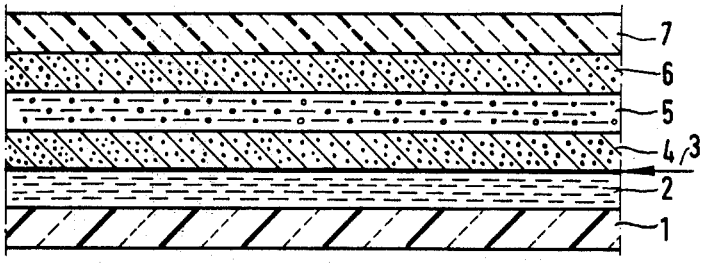
FIGS. 1 to 13 show assemblies which comprise either a stripping position or stripping layer.

In FIG. 1 there is shown a photographic material according to the present invention which can be used for X-ray film material.

As shown in FIG. 1 the material comprises a transparent photobase 1 having coated thereon a bleachable dye-in-gelatin layer 2. Above this is the stripping position 3. Above the stripping position 3 is a carbon black layer 4 and above this a conventional silver halide emulsion layer 5 is sandwiched between two carbon black layers 4 and 6 and therefore the photographic material can be handled in daylight. The material may be exposed to X-rays and after exposure it can be processed using an aqueous acid solution of the bleach-developer compound as just described to yield a negative silver image. The silver halide layer and the two carbon black layers and the supercoat layer are then stripped off the dye layer for recovery of the silver. The negative dye image on the base can then be viewed by transmission.

For convenience the expression "X-ray" as used in the specification is intended to cover all very short wave photographically useful radioactive rays such as those emenating from an X-ray tube, radium or radioactive isotopes and also radioactive radiation such as $\beta$ particles.

Figure 2:
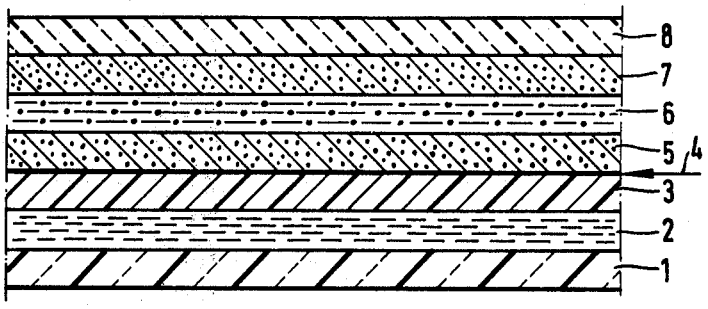

In FIG. 2 there is shown photographic material according to the present invention which can be used as X-ray material for reflection viewing. In this embodiment there is coated on a transparent film base 1 in order a bleachable dye-in-gelatin layer 2, a white opaque layer 3, stripping position 4, a carbon black layer 5, a conventional silver halide emulsion layer 6, a carbon black layer 7 and a supercoat layer 8.

In this case as in the case of the material of FIG. 1 the photographic material is processed to yield a negative image. But in this material an extra white opaque layer is present. This may consist for example of baryta or titanium oxide dispersed in gelatin. In this material the white opaque layer acts as a reflective base for the negative dye image which is viewed by reflection through the photobase.

Figure 3:
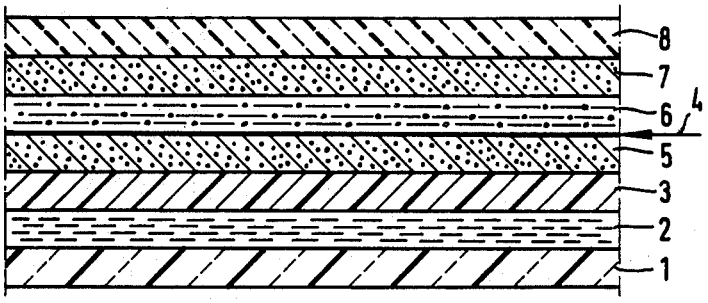

FIG. 3 shows an alternative embodiment of the material of FIG. 2. In this figure the layers have the same numbers as in FIG. 2 but the stripping position has now been altered and is between the lower carbon black layer 5 and the silver halide emulsion layer 6. When the silver halide emulsion layer is stripped off after processing the carbon black layer is then attached to the white opaque layer.

The main advantages of the photographic material as described with references to FIGS. 1 to 3 is that all silver in the silver halide emulsion layer may be recovered and the film material is insensitive to daylight and thus may be handled in the unexposed state in normal daylight conditions. However the photographic material of the present invention can also be used in a normal camera or process camera if the top carbon black layer is omitted. Such material in which there is no carbon black layer at all is shown in the accompanying FIG. 4 in which there is coated on an opaque photobase 1 in order a bleachable dye-in-gelatin layer 2, stripping position 3, a silver halide emulsion layer 4 and a supercoat layer 5. Preferably this material comprises in layer 4 a direct positive emulsion and thus when processed yields a direct positive dye image which is viewed by reflection. In this case the material cannot be handled at any stage in daylight conditions before the silver halide layer has been stripped off.

Figure 5:
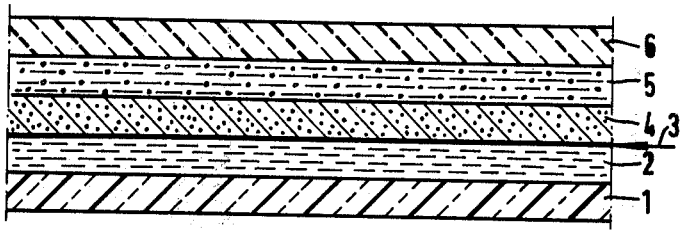

Yet another embodiment of the material of the present invention is shown in the accompanying FIG. 5. In this material there is coated on a transparent photobase 1 in order a bleachable dye-in-gelatin layer 2, a stripping position 3, carbon black layer 4, silver halide emulsion layer 5 and supercoat layer 6. In this case the material produces a final dye image which may be viewed by transmission. In the case of this material exposure must be in a camera or other light-tight exposure chamber. However if the material is processed by a method wherein an activator metal foil which is light opaque is placed in contact with the photographic material on the suppercoat side then the processing may be carried out under daylight conditions.

Figure 6:
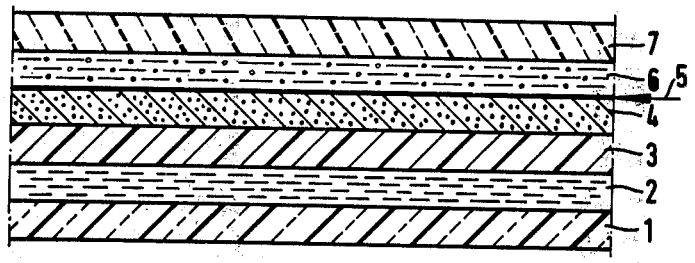

Another embodiment of the invention is shown in FIG. 6 in which there is coated on a transparent photobase 1 in order a bleachable dye-in-gelatin layer 2, white opaque layer 3, carbon black layer 4, stripping position 5, silver halide layer 6 and supercoat layer 7. In this case also, exposure must be in a camera or light-tight exposure chamber. The silver halide emulsion layer 6 may be a direct positive emulsion and in which case after processing there is produced a direct positive image which is viewed by reflection. Alternatively if a conventional silver halide emulsion is used there is produced a negative image which is viewed by reflection, although of course it would be more equal in this case to employ material which would produce a direct positive image as the image is viewed by reflection unless exposure were to X-rays when it is usual to view negative images.

The assemblies shown in FIGS. 1 to 6 may be processed by the application of an acid solution which comprises a bleach-developer compound. This bleach-developer compound may be a preformed reduced azine. However bleach-developer compounds which comprise an aqueous acid solution of metallic ions in their lower valency state are especially suitable, e.g. titanous ions stabilised with ethylene diamine tetraacetic acid. Such solutions remain active for some time. Alternatively, as mentioned with reference to FIG. 5, the inactive bleach-developer solution can be used together with an activator metal foil, e.g. aluminium or zinc foil, the metal reducing the inactive bleach-developer to the active form as it contacts the photographic assembly.

Figure 7:
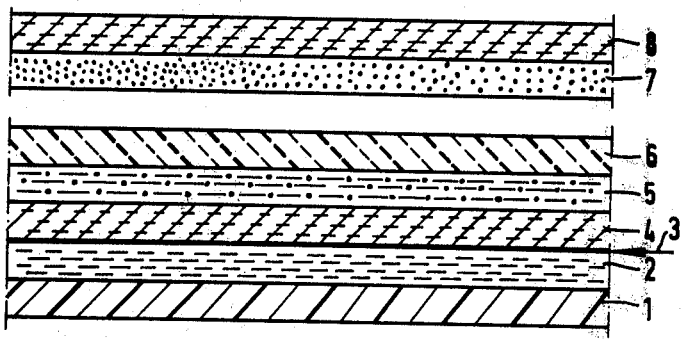
Figure 8:
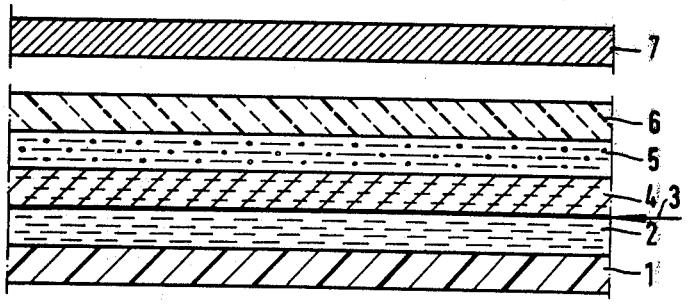

Such methods of processing are shown in FIGS. 7 and 8. In FIG. 7 the photographic assembly comprises a white reflecting photobase 1 on which is coated a bleachable dye-in-gelatin layer 2. A stripping position 3 is present between layer 2 and layer 4 which is a black opaque layer and coated on layer 4 is a silver halide emulsion layer 5 on which is coated a thin supercoat layer 6.

The inactive bleach-developer solution is applied to the supercoat layer 6 and the assembly is then contacted with a zinc paste layer 7 which is coated on to a black opaque paper base 8.

The material of FIG. 7 can be processed in the light after the black paper has been brought into contact therewith.

A dye image is obtained in the image layer 2 and layers 4–8 are stripped off.

In FIG. 8 the material of FIG. 5 is shown with an aluminium foil 7 above it. After exposure the inactive bleach-developer acid solution is placed on the supercoat layer 6 and the metal foil pressed in contact therewith.

FIGS. 9–13 show similar assemblies to those of FIGS. 1–6 in that each comprises a stripping layer but in the case of the assemblies 9–12 each also comprises a metal acitvating layer.

Figure 4:
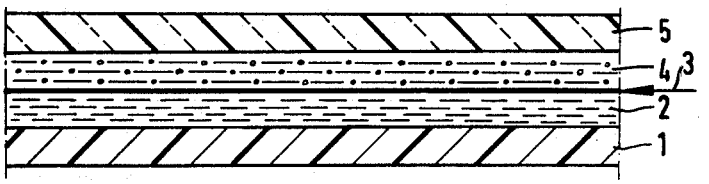
Figure 9:
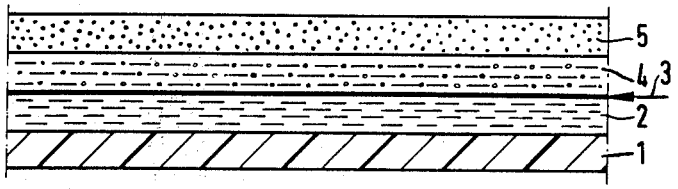

The assembly of FIG. 9 is similar to the assembly of FIG. 4 but there is present in the supercoat layer 5 a dispersion of zinc powder.

Figure 10:
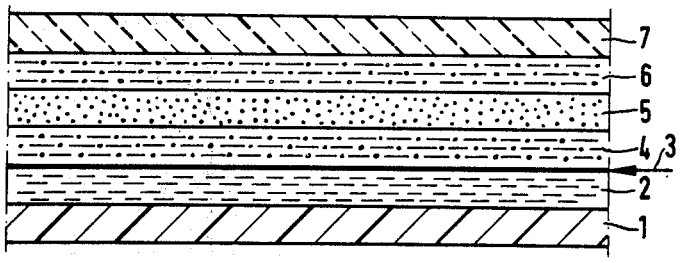

The assembly of FIG. 10 is somewhat similar to that of FIG. 4 except that coated on the metal layer 5 is another silver halide emulsion layer 6 and coated on that a thin supercoat layer 7. The presence of the second silver halide emulsion layer is to enhance the dye image formed in layer 2.

Figure 11:
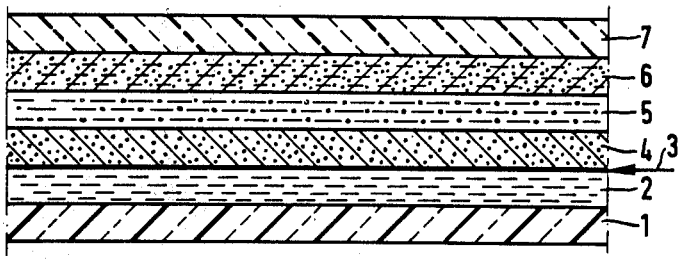

The assembly of FIG. 11 is similar to the assembly shown in FIG. 1 except that in the carbon black layer 6 of FIG. 11 there is present a fine dispersion of aluminium metal particles.

Figure 12:
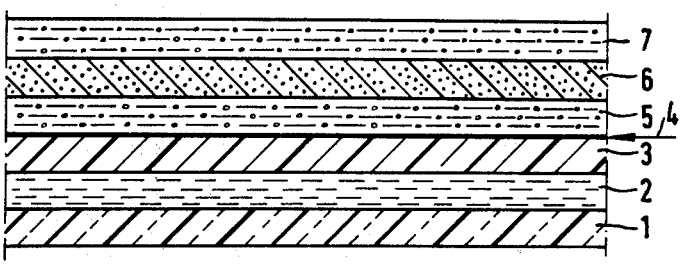

In the assembly shown in FIG. 12 there is a transparent photobase 1 on which is coated a bleachable dye-in-gelatin layer 2, a white reflecting layer 3, a silver halide emulsion layer 5, a copper particle layer 6 and a silver halide emulsion layer 7. After exposure an inactive bleach-developer solution is applied to the emulsion layer 7 and this diffuses down to the metal layer 6 where it becomes activated. The active bleach-developer compound develops the latent image in both of the silver halide emulsion layers and in the non-latent image areas diffuses to the bleachable dye layer 2 where it bleaches the dye to form a dye image. The stripping layer 4 is then activated and the dye image can be viewed through the base against the white reflecting layer 3. The effect of the two silver halide emulsion layers is to strengthen the dye image formed in layer 2.

Figure 13:
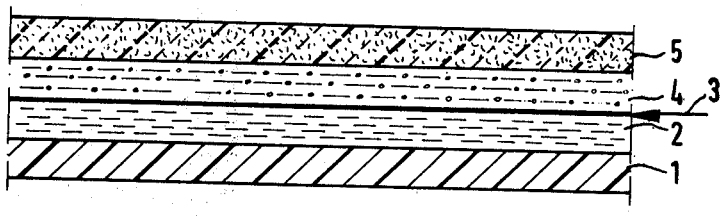

The assembly shown in FIG. 13 is similar to the assembly shown in FIG. 4 except that the supercoat layer 5 of FIG. 13 comprises a fine dispersion of zinc metal flakes.

Processing of the assemblies shown in FIGS. 9–13 is carried out by applying to the topmost layer an acid solution of an inactive bleach-developer compound. When the inactive bleach-developer compound reaches the metal layer it becomes active and is able to develop the latent silver image in the silver halide emulsion layer or layers and after diffusion into the bleachable dye layer there to bleach the dye to form an image.

Photographic assemblies of use in the present invention which are integral, i.e. which remain in one piece after processing are shown in FIGS. 14–19.

Figure 14:
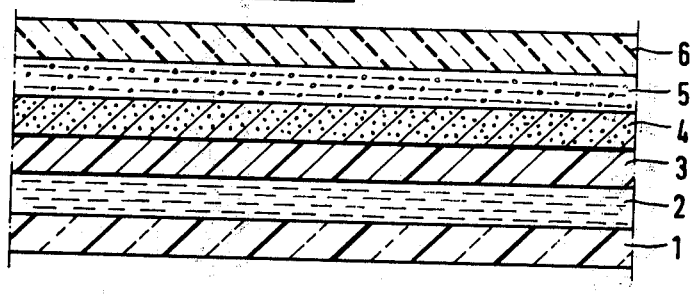
FIGS. 14 to 19 show integral assemblies.

In FIG. 14 there is coated on photobase 1 in order a bleachable dye-in-gelating layer 2, a white reflecting layer 3, a carbon black opacifying layer 4, a silver halide emulsion layer 5 and a supercoat layer 6. Exposure must be in a camera or light-tight exposure chamber. The emulsion layer 5 may be chosen to produce a direct positive image or a negative image.

Figure 15:
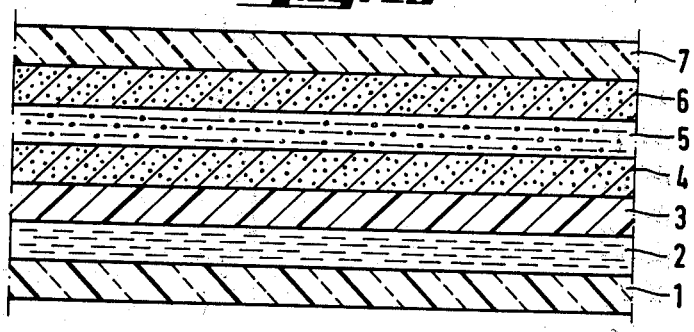

In FIG. 15 there is coated on a photobase 1 in order a bleachable dye-in-gelatin layer 2, a white refelcting layer 3, a carbon black opacifying layer 4, a silver halide emulsion layer 5, a carbon black opacifying layer t and a supercoat layer 7. Exposure of these material must be to X-rays. The silver halide emulsion of this layer would normally be a conventional emulsion so yielding a negative image to be viewed by reflection as X-ray films are by custom processed to yield negative images.

Figure 16:
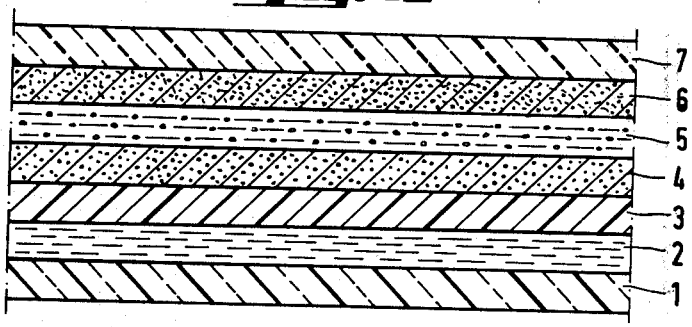

In an alternative embodiment shown in FIG. 16 layer 6 instead of being a carbon black opacifiying layer is a zinc powder+carbon black opacifying layer. Such material can be processed after exposure to yield a dye image therein by application of an acid solution of an unreduced bleach-development compound of the type wherein the reduced form acts as a silver halide developing agent.

Figure 17:
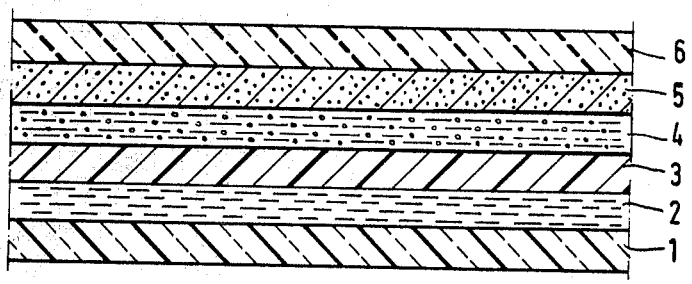

The assembly of FIG. 17 is similar to that of FIG. 16 except that the carbon black+zinc layer is located between the silver halide emulsion layer and the white reflecting layer and there is no top carbon black layer.

The assemblies of FIGS. 15 and 16 can be exposed only to X-rays but can be daylight processed whilst the assembly of FIG. 17 is light-sensitive and the usual precautions must be taken during exposure and also during processing unless a light-opaque mask is placed over the assembly during processing.

Figure 18:
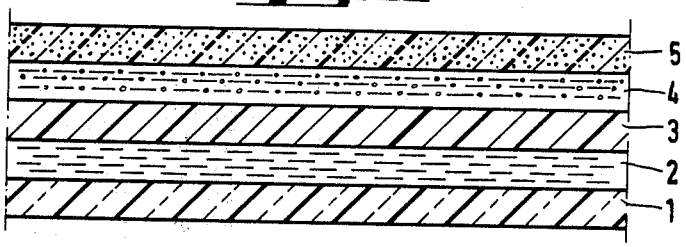

In the assembly shown in FIG. 18 a transparent photobase 1 has coated thereon a bleachable dye layer 2, a white reflecting layer 3, a silver halide emulsion layer 4 and a supercoat layer 5 which comprises fine zinc metal plates.

Application of an acid solution of an inactive bleach-developer causes the bleach-developer to diffuse into the metal layer where it becomes activated and thence to the silver halide emulsion layer where the bleach-developer compound develops the latent silver image. In the non-latent image areas it diffuses to the bleachable dye layer where it contra-silver-imagewise bleaches the dye to form a dye image.

Figure 19:
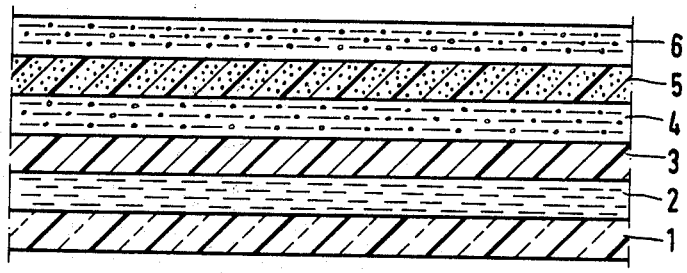

The assembly of FIG. 19 is similar to that of FIG. 18 except that coated on layer 5 is another silver halide emulsion layer 6. The effect of the second silver halide emulsion layer is to reinforce the final dye image in layer 2.

In none of the assemblies shown in FIGS. 14–19 is there a stripping position or layer. This means that all the silver present initially is still present in the final image material. However it is possible to make use of a very low coating weight of silver which when the material is exposed and processed yields a very low density image, too low in fact to be of use as a final image. However the final image in the assemblies of FIGS. 14–19 is a dye image of very acceptable density as a final image. Thus the amount of silver used can be small as the silver is used merely as the radiation sensitive agent and not as the image-producing substance as well although it is still present in the assembly but is invisible as it is on the other side of the white reflecting layer to the dye image.

Figure 20:
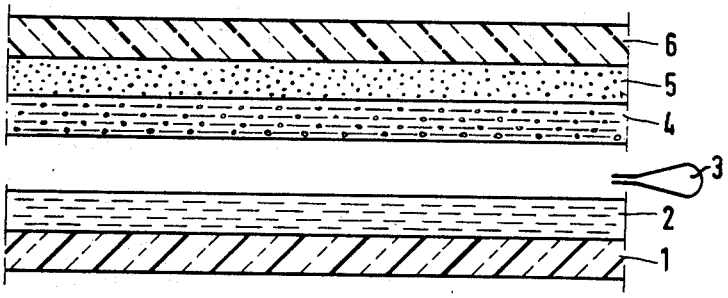
FIGS. 20 to 22 show assemblies which comprise a photosensitive portion and an image portion which are only brought together during processing.

In FIG. 20 there is shown a photographic assembly of use in the present invention which comprises two separate components. The image component consists of a transparent photobase 1 on which is coated a bleachable dye-in-gelatin layer 2. The photosensitive component comprises a supercoat layer 6 which is transparent but which is sufficiently thick and rigid to act as a photobase. On layer 6 is coated a metal powder (e.g. aluminium, zinc or copper) and gelatin binder layer 5. On layer 5 is coated a camera speed silver halide emulsion layer 4.

Between layer 4 and layer 2 there is shown a pod 3 which contains an acid solution of a bleach-developer compound in its higher valency state but which in its lower valency state is able to act both as a silver halide developing agent and as a dye bleaching agent.

The assembly of FIG. 20 is of use in a self-processing camera of the type known per se. In operation the assembly, preferably with the pod 3 already in position between the two components of the assembly, is imagewise exposed through the supercoat layer 6. After exposure the assembly is led through a pair of driven rollers which rupture the pod 3 and cause the processing fluid contained therein to spread evenly between the two components and it also brings the two components into very close contact. The unreduced bleach-development compound in the acid solution then diffuses into both components but is not able to either develop the latent image in the silver halide nor bleach the dye until some of the compound has reached layer 5. There it is reduced to the active form. The reduced compound then diffuses through the assembly.

In layer 4 it develops the latent image areas and is de-activated. In the non-latent image areas it continues to diffuse down through the thin layer of solution between layers 4 and 2 and into layer 2 where it acts to bleach the imagewise bleachable dye to form a dye image.

In this case as a camera speed emulsion is used the emulsion is preferably a negative emulsion. Thus a negative dye image will be formed.

Figure 21:
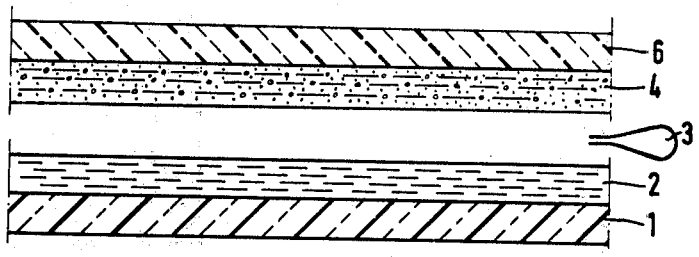

The assembly of FIG. 21 is similar to that of FIG. 20 except that in the silver halide emulsion layer 4 there are also present fine particles of zinc dust and no metal layer 5.

Figure 22:
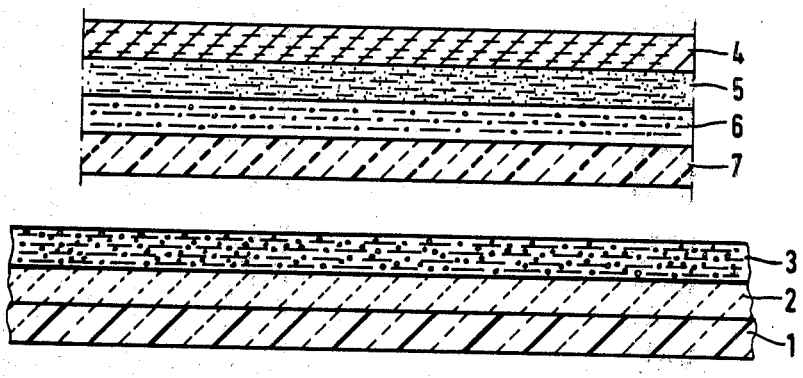

In FIG. 22 there is shown another photographic assembly of use in the present invention which comprises two separate components. The lower component comprises a transparent photobase, a neutralising layer 2, a bleachable dye(s)+gelatin layer 3. The upper component comprises coated on a paper base 4 a zinc powder+binder layer 5, a silver halide emulsion layer 6 and a supercoat layer 7. The lower component may be part of a long web of material.

In operation after the upper component has been imagewise exposed in a camera through the supercoat layer 7 the upper component is placed juxatposed the lower component, layer 7 facing layer 3. Then an inactive form of bleach-developer compound is spread either as a dispersion or as a solution on either layer 7 or layer 3 and the two components are held together in close contact.

The inactive bleach-developer compound then diffuses into layer 5 where it is converted to the active form. It then diffuses into layer 6 where in the latent image areas it develops the latent silver image whilst in the non-latent image areas it diffuses in counter-imagewise fashion through the protective layer 7 to the dye layer 3 where it bleaches the dye, thus yielding a dye image. The upper component can then be removed and the silver recovered therefrom. The image can be viewed through the transparent base. In practice if the lower component is part of a web a series of dye images will be present along the length of the web if the process has been repeated using a series of exposed upper components.

Figure 23:
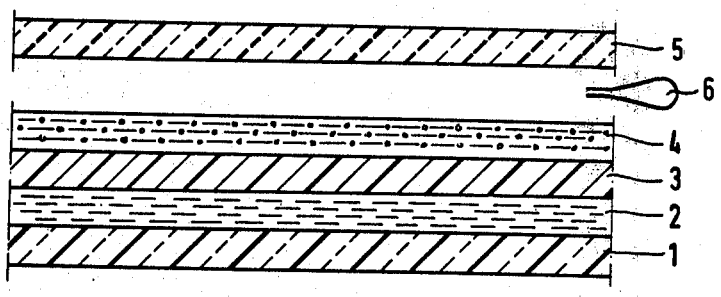
FIGS. 23 and 24 show assemblies in two sections suitable for in-camera processing.

In FIG. 23 there is shown a photographic assembly of use in the present invention which comprises two separate components. The first component consists only of a separate supercoat 5. The other component comprises a transparent photobase 1 having coated thereon in order a bleachable image dye layer 2, a white reflecting layer 3 and a silver halide layer 4. Between the supercoat layer 5 and the silver halide layer 4 is shown a pod 6 which contains a preformed bleach-developer compound.

The assembly of FIG. 23 is of use in a self-processing camera of the type known per se. In operation the assembly with the supercoat layer 5 in close contact with the silver halide emulsion layer 4 is imagewise exposed in a camera. Preferably the pod 6 is present in the assembly with its outlet between two edges of the supercoat and silver halide layers but is so positioned that close optical contact between these two layers is not impaired.

After exposure the assembly is led through a pair of driven rollers which rupture the pod 6 and cause the processing fluid contained therein to spread evenly between the supercoat layer 5 and this silver halide layer 4. The preformed bleach-developer compound then diffuses into the silver halide layer and develops the latent image therein in the latent image areas. In the non-latent image areas it diffuses in a counter-imagewise manner through the white reflecting layer 3 and into the dye(s)+gelatin layer 2 where it bleaches the bleachable layer to form a dye image. The image can then be viewed by reflection through the photobase 1.

Figure 24:
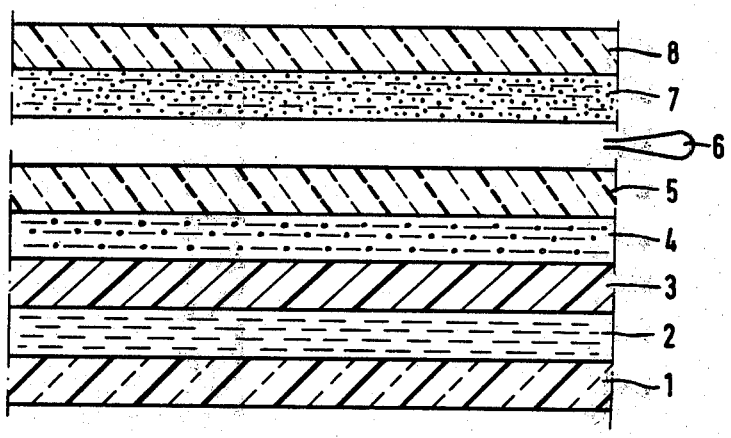

In FIG. 24 there is shown a photographic assembly of use in the present invention which also comprises two separate components. The first component consists of a supercoat 8 which has coated thereon a layer 7 which consists of powdered zinc in a gelatin binder. The other component comprises a transparent photobase 1 having coated thereon in order a bleachable image dye layer 2, a white reflecting layer 3, a silver halide layer 4 and a supercoat layer 5. Between the supercoat layer 5 and the zinc layer 7 is shown a pod 6 which contains an unreduced bleach-developer compound.

The assembly of FIG. 24 is also of use in a self-processing camera of the type known per se. In operation the assembly with the zinc layer 7 in close contact with the supercoat layer 5 is imagewise exposed in a camera. Preferably the pod 6 is present in the assembly with its outlet between two edges of the supercoat and zinc layers but is so positioned that close optical contact between these two layers is not impaired.

After exposure the assembly is led through a pair of driven rollers which rupture the pod 6 and cause the processing fluid contained therein to spread evenly between the supercoat layer 5 and the zinc layer 7. The unreduced bleach-developer compound is reduced by the zinc layer and then diffuses into the silver halide layer and develops the latent image therein in the latent image areas. In the non-latent image areas it diffuses in a counter-imagewise manner through the white reflecting layer 3 and into the dye(s)+gelatin layer 2 where it bleaches the bleachable layer to form a dye image. The image can then be viewed by reflection through the photobase 1.

An example of a suitable white reflecting layer for use in the material of FIGS. 2, 3, 6, 8, 12, 14–19, 23 and 24 is as follows:

| | |
|---|---|
| Titanium dioxide (mean particle size 1.5μ) | 15 g |
| Gelatin (4% aqueous solution) | 50 ml |
| Sodium dodecyl sulphate (28% aqueous solution) | 0.3 ml |
| Aryl alkyl polyethylene oxide condensate (6% solution in 50/50 ethanol/water) | 3.0 ml |

dispersed using a homogeniser or ultrasonic mixer coated to give a layer containing 27 $g/m^{-2}$ $TiO_2$.

An example of a suitable carbon black layer for use in the material of FIGS. 1–3, 5–8, 11 and 14–17 is as follows:

| | |
|---|---|
| Gelatin | 3 g |
| Water | 40 ml |
| Carbon black dispersion No. 12* | 5 ml |
| Wetting agent (5% aqueous solution) | 2.5 ml |

*From Chemische Werke Brockhues A.G. Niederwellnt/Rheingau.

mixed gently for two minutes coated to give a layer containing 2.7 $g/m^{-2}$ C.

There may be present in the photographic material of the present invention yet other layers, for example a neutralising layer, a timing layer, a mordant layer which may be used to trap amines released during the bleaching of azo dyes when such dyes are used as the image dye, or a layer to control the swelling of the gelatin layers. Preferably any of the above layers, if present, are located between the supercoat layer and the silver halide emulsion layer or between the dye layer and the photobase so as not to prolong nor interfere with the diffusion path of the bleach development compound to the bleachable dye layer.

The preferred binder for all layers is gelatin. However so-called gelatin extenders may be present for example those derived from synthetic colloid latexes, especially acrylic latexes. Other natural or synthetic binders may be used either alone or in admixture with the gelatin, for example albumin, casein, polyvinyl alcohol and polyvinyl pyrrolidone.

The halide content and ratio of the silver halide present in the silver halide emulsion layer depends on how the material is to be used but all the usual pure bromide, chlorobromide, iodobromide and chlorobromoiodide silver halides are of use in the photographic material in use in the process of the present invention. There may also be present in the silver halide emulsion layer any of the usual addenda present in silver halide emulsion layers such as sulphur and gold sensitizers, emulsion stabilizers, wetting agents and antifoggants.

The photobase used may be of any of the usual bases used for photographic materials, for example if the base is transparent it may be composed of cellulose triacetate, cellulose acetatebutyrate, oriented and subbed polystyrene, polycarbonate or polyester, such as polyethylene terephthalate. If the base is opaque it may be of any of the above listed film base materials which has been pigmented for example with barium sulphate or titanium dioxide to render its coated surface reflecting, or it may be a paper base having a baryta coating thereon or polyethylene coated paper base. Alternatively it may be voided polyester base.

As hereinbefore stated processing is preferably carried out in an aqueous medium and this is preferably rendered acid with a suitable acid or a buffer mixture, advantageously to a pH value between 0 and 4. The processing and developing speed and the gradation can be varied within wide limits, as a function of the pH value. Preferred suitable acids are: aliphatic, aromatic or heterocyclic mono-, di- and tri-carboxylic acids, which can also contain substituents such as chlorine, bromine and iodine atoms or hydroxyl, nitro, amino or acylamino groups, and also aliphatic or aromatic sulphonic acids or phosphoric acid and mineral acids such as HF, HCl, HBr, $HClO_4$, $HNO_3$, $H_2SO_4$, $H_3PO_4$ and $H_2CO_3$; also $HSO_3^-$, $SO_2$, sulphamic acid. Suitable buffers are: $[Al(H_2O)_6]^{3+}$ and $HBF_4$.

Preferably an antifoggant is present in the aqueous acid processing medium for example iodide or bromide ions or 1-phenyl-5-mercapto-tetrazole.

The following Examples will serve to illustrate the invention:

EXAMPLE 1

An assembly as shown in FIG. 24 was prepared by coating sequentially onto 0.1 mm thick transparent cellulose triacetate photobase the following layers:

Part 1

1. A gelatin layer containing 0.9 $g/m^{-2}$ of the dyestuff of formula (5) in gelatin 5 $g/m^{-2}$
2. A white reflecting layer
3. A photosensitive silver halide gelatin emulsion layer containing 5.1 $g/m^{-2}$ silver in the form of silver bromoiodide (98.5 mol % AgBr and 1.5 mol % AgI)
4. A supercoat layer containing gelatin 1.0 $g/m^{-2}$.

Part 2

1. A zinc powder layer containing 1.6 $g/m^{-2}$ of zinc dust in gelatin 3.2 $g/m^{-2}$.

This assembly was not tested in a camera but in darkroom conditions. The test procedure was as follows:

After exposure of the light sensitive part of the assembly to light behind a grey wedge the material was processed in the dark by contacting the emulsion side with the zinc powder layer of part 2 onto which had been applied a processing composition of the following formulation:

| | | |
|---|---|---|
| Pyrazine | | 5 g |
| Sulphuric acid (5N) | | 10 ml |
| Hydroxyethyl cellulose (Natrosol type 250HH) | | 2 g |
| Water | to | 100 ml. |

The two assembly parts were separated after 40 seconds. A blue image wedge was obtained in layer 1. The density of this was acceptably dark as a final image.

EXAMPLE 2

The dyestuff of formula (6) was coated and tested as described above. The assembly parts were separated after 80 seconds. A blue image wedge was obtained. The density of this image was acceptably dark as a final image.

EXAMPLE 3

The dyestuff of formual (18) (murexide) was coated and tested as above. The assembly parts were separated after 60 seconds. A purple image was obtained, the density of which was acceptably dark as a final image.

EXAMPLE 4

A pyrazolone dyestuff of formula (9) which had the formula:

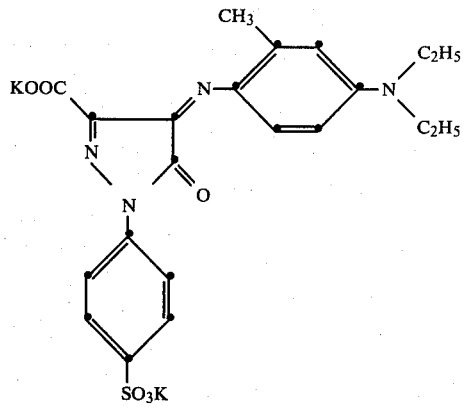

(22)

was coated and tested as above. The assembly parts were separated after 100 seconds. A brown image was obtained which was acceptably dark as a final image.

We claim:

1. A process for the production of a photographic image which comprises the steps of:

(a) imagewise exposing a photographic assembly which comprises at least during a silver halide developing step, in order optionally a supercoat layer, at least one silver halide emulsion layer, a layer containing a layer substantive azamethine compound of the general formula

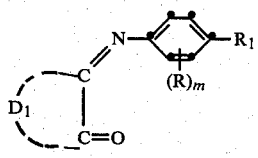

(2)

or

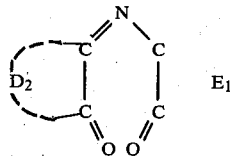

(14)

where $R_1$ represents unsubstituted or substituted amino or hydroxy, R represents substituent groups which may be the same or different, m is 0 to 3 and $D_1$ represents the atoms necessary to complete a hydroxypyridone, pyrazolone, barbituric acid or thiobarbituric acid, ninhydrine, oxindole, dimedone or Meldrum's acid ring system and both $D_2$ and $E_1$ represent the atoms necessary to complete a bishydroxy-pyridone ring system or to yield murexide, and a support, there being optionally one or more interlayers between each of said components, (b) treating the exposed photographic assembly with an aqueous acid processing bath so as to provide in the silver halide emulsion layer or layers a solution or dispersion of an azine compound in its reduced form or a metallic ion which is able to act as a silver halide developer in an acid solution thereby to develop the latent silver image in the silver halide emulsion(s) and (c) in the non-latent image areas allowing the reduced azine compound or metallic ions to diffuse in a counter-imagewise manner from the silver halide emulsion layer or layers to the layer containing the compound of formula (2) or (14) and there to bleach the compound to form a dye image.

2. A process according to claim 1 wherein the azamethine compound is a hydroxypyridone compound of the general formula

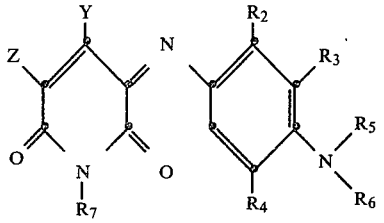

(3)

wherein $R_7$ represents hydrogen or optionally substituted alkyl, aralkyl, cycloalkyl, aryl or a heterocyclic radical or optionally substituted amino, Y represents hydrogen, hydroxy, cyano, —$COOR^1$, —$CONR^1R^2$, —$COR^1$ or optionally substituted alkyl, aralkyl, cycloalkyl, aryl or a heterocyclic radical and Z is H or represents cyano, —$COOR^3$, —$CONR^3R^4$, —$SO_3H$, —$SO_3^-$ or —$COR^3$, where $R^1$, $R^2$, $R^3$ and $R^4$ each independently represent hydrogen or optionally substituted alkyl, aralkyl, cycloalkyl, aryl or a heterocyclic radical, $R_2$, $R_3$ and $R_4$ each independently represent hydrogen, halogen, optionally substituted alkyl, cycloalkyl or alkoxy and $R_5$ and $R_6$ each independently represent hydrogen or optionally substituted alkyl, aralkyl, cycloalkyl, aryl or a heterocyclic radical or $R_5$ and $R_6$ together with the nitrogen atom to which they are attached form a 5- or 6-menbered nitrogen containing heterocyclic ring, or $R_3$ and $R_5$ together with the nitrogen atom and $R_5$ and $R_6$ together with the nitrogen atom form two nitrogen containing heterocyclic rings.

3. A process according to claim 2 wherein Z in formula (3) is cyano, —$COOR^3$, —$CONR^3R^4$ or —$COR^3$ where $R^3$ and $R^4$ have the meanings assigned to them in claim 2.

4. A process according to claim 3 wherein Z in formula (3) is cyano.

5. A process according to claim 2 wherein Y and $R_7$ are each alkyl having from 1 to 4 carbon atoms.

6. A process according to claim 2 wherein Y is alkyl having from 1 to 4 carbon atoms and $R_7$ is hydrogen.

7. A process according to claim 2 wherein $R_2$, $R_3$ and $R_4$ in formula (3) are each hydrogen.

8. A process according to claim 2 wherein $R_5$ and $R_6$ are each alkyl or alkoxy wherein the alkyl moiety contains from 1 to 4 carbon atoms.

9. A process according to claim 2 wherein the hydroxy-pyridone has the formula

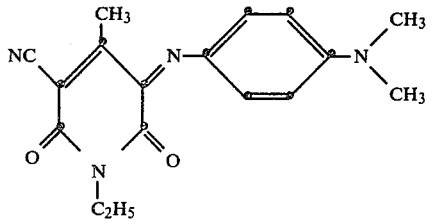

(5)

10. A process according to claim 2 wherein the hydroxy-pyridone has the formula

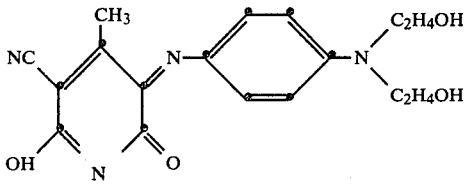

(6)

11. A process according to claim 1 wherein the azamethine compound is a hydroxypyridone compound of general formula

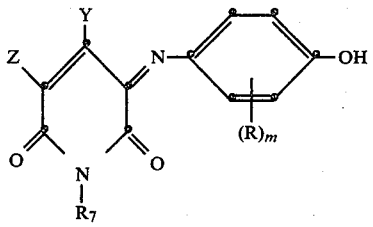

(7)

where R and m have the meanings assigned to them in claim 1, $R_7$ represents hydrogen or optionally substituted alkyl, aralkyl, cycloalkyl, aryl or a heterocyclic radical or optionally substituted amino, Y represents hydrogen, hydroxy, cyano, —$COOR^1$, —$CONR^1R^2$, —$COR^1$ or optionally substituted alkyl, aralkyl, cycloalkyl, aryl or a heterocyclic radical and Z is H or represents cyano, —$COOR^3$, —$CONR^3R^4$, —$SO_3H$, —$SO_3^-$ or —$COR^3$, where $R^1$, $R^2$, $R^3$ and $R^4$ each independently represent hydrogen or optionally substituted alkyl, aralkyl, cycloalkyl, aryl or a heterocyclic radical, $R_2$, $R_3$ and $R_4$ each independently represent hydrogen, halogen, optionally substituted alkyl, cycloalkyl or alkoxy.

12. A process according to claim 11 wherein the hydroxy-pyridone has the formula

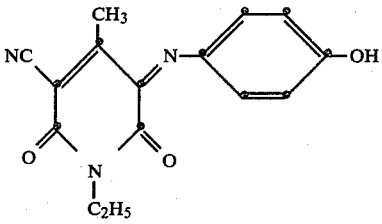

(8)

13. A process according to claim 1 wherein the azamethine compound is a pyrazolone compound of the general formula

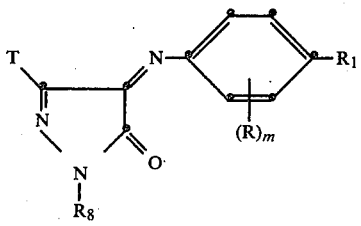

(9)

where R, $R_1$ and m have the meanings assigned to them in claim 1 and T and $R_8$ are each hydrogen or a substituent group.

14. A process according to claim 13 wherein m is O and $R_1$ is dialkyl substituted amino.

15. A process according to claim 13 wherein $R_8$ is optionally substituted aryl.

16. A process according to claim 1 wherein the azamethine compound is a derivative of barbituric acid or thiobarbituric acid of the general formula

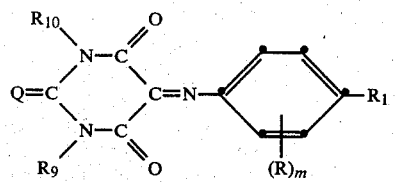

(10)

where R, $R_1$ and m have the meanings assigned to them in claim 1 and $R_9$ and $R_{10}$ are each hydrogen, alkyl or aryl each of which may be optionally substituted, and Q is oxygen or sulphur.

17. A process according to claim 1 wherein the azamethine compound is a derivative of ninhydrin of the general formula

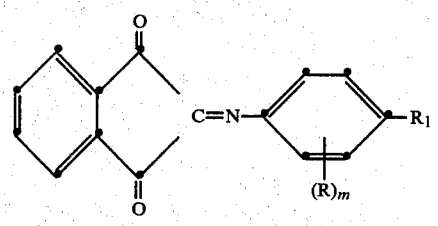

(11)

where R, $R_1$ and m have the meanings assigned to them in claim 1.

18. A process according to claim 1 wherein the azamethine compound is a derivative of oxindole of the general formula

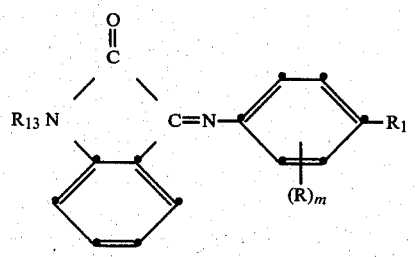

(12)

where R, $R_1$ and m have the meanings assigned to them in claim 1 and $R_{13}$ is hydrogen, alkyl or aryl each of which may be optionally substituted.

19. A process according to claim 1 wherein the azamethine compound is a derivative of dimedone or Meldrum's acid of the general formula

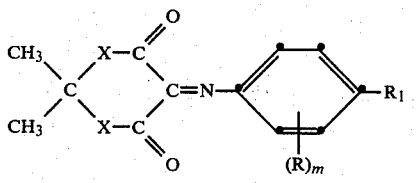

(13)

where R, $R_1$ and m have the meanings assigned to them in claim 1 and X is $—CH_2—$ or —O—.

20. A process according to claim 1 wherein the azamethine compound is of the general formula

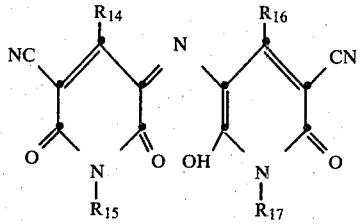

(19)

where each of $R_{14}$, $R_{15}$, $R_{16}$ and $R_{17}$ are methyl or ethyl.

21. A process according to claim 1 wherein the azamethine compound is murexide

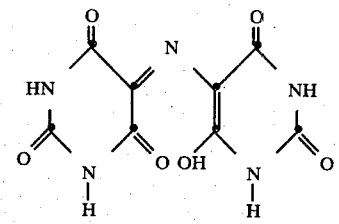

(18)

22. A process according to claim 1 wherein the azamethine compound is present in the layer of the photographic assembly as a solid dispersion.

23. A process according to claim 1 wherein the azine compound in its reduced form or a metallic ion which is able to act as a silver halide developer in an acid solution is in the form of a preformed solution or dispersion which is applied to the exposed photographic assembly in step (b).

24. A process according to claim 1 wherein a solution or dispersion of nonreduced azine or metallic ion in a higher valency state than the active form is contacted with a metal which in the electrochemical series is above silver and up to and including aluminium which renders the non-reduced azine or metallic ion active just before or whilst the solution or dispersion is applied to the exposed photographic assembly in step (b).

25. A process according to claim 1 wherein a solution or dispersion of non-reduced azine or metallic ion in a higher valency state than the active form is applied to the photographic assembly in step (b), the photographic assembly comprising either in the supercoat layer or below the supercoat layer and above the bottom-most silver halide emulsion layer a metal which in the electrochemical series is above silver and up to and including aluminium in layer form which renders active the non-reduced azine or metallic ion in a higher valency state than the active form.

26. A process according to claim 1 wherein the non-reduced azine or metallic ion in a higher valency state than the active form is present initially in a layer in the photographic assembly and in step (b) a solvent for the non-reduced azine or metallic ions is applied to the exposed photographic assembly and the thus formed solution is treated in the assembly to convert the non-reduced azines or metallic ions to the active form.

27. A process according to claim 26 wherein the solution of the non-reduced azine or metallic ion in a higher valency state than the active form is rendered active by bringing it into contact with a metal which in the electrochemical series is above silver and up to and including aluminium which renders the non-reduced azine or metallic ions active and which is also present in layer form in the photographic assembly.

28. A process according to claim 1 wherein a solution or dispersion of non-reduced azine or metallic ion in a higher valency state than the active form is subjected to electrolysis to convert the inactive to the active form just before or whilst the solution or dispersion is applied to the photographic assembly.

29. A process according to claim 26 wherein the photographic assembly is subjected to electrolysis at the same time or just after the solvent is applied to the assembly thereby converting the inactive to the active form in the assembly.

30. A process according to claim 1 wherein the photographic assembly is prepared as two sections, one section comprising the supercoat and the silver halide emulsion layer(s) and the other section comprising the layer which contains the compound of formula (2) or (14) and the support base.

31. A process according to claim 1 wherein the photographic assembly is prepared as a single assembly which comprises the supercoat, the silver halide emulsion layer(s) and the layer which contains the compound of formula (2) or (14) all coated on the support base.

32. A process according to claim 31 wherein in the photographic assembly used there is either a stripping layer or a stripping position between the silver halide emulsion layer(s) and the layer which comprises the compound of formula (2) or (14).

33. A process according to claim 32 wherein the stripping layer comprises phthalated gelatin.

34. A process according to claim 1 wherein the silver halide emulsion is a negative working silver halide emulsion.

35. A process according to claim 1 wherein the silver halide emulsion is a direct positive silver halide emulsion.

36. A process according to claim 1 wherein the azine is pyrazine.

37. A process according to claim 1 wherein the azine is a quinoxaline compound which is substituted in the 2-, 3-, 5-, 6-, or 7-position by methyl, methoxy or an optionally acylated hydroxymethyl or by an optionally acylated amino.

38. A process according to claim 1 wherein the metallic ion is chromous, vanadous or titanous.

39. A process according to claim 1 wherein a non-reduced azine or metallic ion in a higher valency state than the active form in an acid solution or dispersion is contacted with a metal which in the electrochemical series is above silver and up to and including aluminium just before or as it is applied to the photographic assembly.

40. A process according to claim 39 wherein the metal is in the form of a metal strip.

41. A process according to claim 40 wherein the metal strip is composed of iron, zinc, tin or aluminium.

42. A process according to claim 39 wherein the metal is in the form of a paste coated on a base.

43. A process according to claim 42 wherein the paste comprises aluminium, zinc, tin, indium or gallium or alloys which include such metals.

44. A process according to any one of claims 1 wherein a non-reduced azine or metallic ion in a higher valency state than the active form is applied as an acid solution or dispersion to the photographic assembly which comprises in a layer thereof a dispersion of a metal which in the electrochemical series is above silver and up to and including lanthanum.

45. A process according to claim 44 wherein the metal used is aluminium, zinc, tin, indium, lanthanum or gallium or alloys which include such metals.

46. A process according to claim 1 wherein in the photographic assembly there is at least one light opaque layer adjacent to a silver halide emulsion layer.

47. A process according to claim 46 wherein there is one silver halide emulsion layer and there is a light-opaque layer on each side thereof.

48. A process according to claim 1 wherein in the photographic assembly there is a white reflecting layer adjacent to the layer containing a compound of formula (2) or (14) on the side remote from the support.

49. A process according to claim 1 wherein the photographic assembly comprises in order a supercoat layer, a light opaque layer, a silver halide emulsion layer, a light opaque layer, a layer containing a compound of formula (2) or (14) and a support.

50. A process according to claim 49 wherein there is present between the second mentioned light opaque layer and the layer containing the compound of formula (2) or (14) a stripping position.

51. A process according to claim 50 wherin the stripping position is a stripping layer.

52. A process according to claim 49 wherein there is present between the second mentioned light opaque layer and the layer containing the compound of formula (2) or (14) a white reflecting layer.

53. A process according to claim 52 wherein there is present between the second mentioned light opaque layer and the white reflecting layer a stripping position.

* * * * *

UNITED STATES PATENT AND TRADEMARK OFFICE

CERTIFICATE OF CORRECTION

PATENT NO. : 4,339,523

DATED : July 13, 1982

INVENTOR(S) : Alexander Psaila et al

It is certified that error appears in the above—identified patent and that said Letters Patent is hereby corrected as shown below:

| | |
|---|---|
| [73] Assignee: | Delete "Basel" and insert --Basle-- |
| Col. 2, line 34 | Delete "is" and insert --to-- |
| Col. 2, lines 53, 54 | Delete "formaula" and insert --formula-- |
| Col. 3, line 47 | Delete "boty" and insert --both-- |
| Col. 6, line 10 | At end of formula delete " 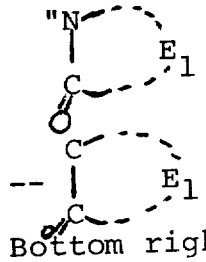 " and insert --  -- |
| Col. 6, line 50 | Bottom right of formula, delete "C=C" and insert --C=O-- |
| Col. 7, line 31 | Delete "formale" and insert -- formulae -- |
| Col. 9, line 39 | Delete "Example" and insert --Examples-- |
| Col. 15, line 30 | Delete "equal" and insert --usual-- |
| Col. 18, line 39 | Delete "juxatposed" and insert --juxtaposed-- |

UNITED STATES PATENT AND TRADEMARK OFFICE

CERTIFICATE OF CORRECTION

PATENT NO. : 4,339,523

DATED : July 13, 1982

INVENTOR(S) : Alexander Psaila et al

It is certified that error appears in the above—identified patent and that said Letters Patent is hereby corrected as shown below:

Col. 21, line 1 — Delete "$HSO_3$-" and insert --$HSO_3^{\ominus}$ --

Col. 21, line 2 — Delete "$3_+$" and insert --$3^{\oplus}$--

Col. 22, line 42 — Delete " 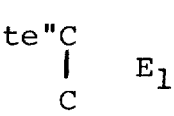 " and insert

-- 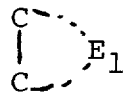 --

Signed and Sealed this

Twelfth Day of October 1982

[SEAL]

Attest:

GERALD J. MOSSINGHOFF

Attesting Officer — Commissioner of Patents and Trademarks